United States Patent [19]

Bernard et al.

[11] Patent Number: 4,526,529

[45] Date of Patent: Jul. 2, 1985

[54] CLEAN COMBUSTION PROCESS/APPARATUS

[75] Inventors: Philippe Bernard, Paris; Francois Prudhon, Versailles, both of France

[73] Assignee: Rhone-Poulenc Chimie De Base, Courbevoie, France

[21] Appl. No.: 612,543

[22] Filed: May 21, 1984

[30] Foreign Application Priority Data

May 20, 1983 [FR] France ..... 83 08393

[51] Int. Cl.[3] ..... F23M 3/00

[52] U.S. Cl. ..... 431/9; 431/8; 431/173; 431/351; 110/238

[58] Field of Search ..... 431/8–10, 431/173, 182, 351, 352; 110/238

[56] References Cited

U.S. PATENT DOCUMENTS

| | | | |
|---|---|---|---|
| 3,376,098 | 4/1968 | Pryor | 431/10 |
| 4,124,353 | 11/1978 | Prudhon et al. | 431/8 |
| 4,257,339 | 3/1981 | Prudhon et al. | 110/238 |
| 4,427,362 | 1/1984 | Dykema | 431/352 |

*Primary Examiner*—Carroll B. Dority, Jr.
*Attorney, Agent, or Firm*—Burns, Doane, Swecker & Mathis

[57] ABSTRACT

The clean combustion of a combustible material is facilely carried out by (i) in situ generating a dispersing first stream of hot combustion gases by establishing a first downstream axially extending, axially symmetrical helical flowstream of combustion-supporting gases in a first combustion reaction zone and by introduction and combustion of a combustible fluid feedstream therein, (ii) serially directly contacting and intimately admixing the material cleanly combustible hereby with said first stream of hot combustion gases at a zone of reduced pressure thereof defining the inlet end of a second combustion reaction zone and whereat and downstream thereof said first stream of hot combustion gases is also in the configuration of an axially symmetrical helical flowstream, (iii) the amounts of said combustion-supporting gases and said combustible fluid being such as to effect essentially instantaneous dispersion and entrainment of fine particles of said cleanly combustible material at and downstream of said point of direct contact with said first stream of hot combustion gases, (iv) establishing a second downstream axially extending, axially symmetrical helical flowstream of combustion-supporting gases in said second combustion reaction zone, and (v) whereby said cleanly combustible material dispersed and entrained within said first stream of hot combustion gases is introduced into and combusted within said second stream of combustion-supporting gases in said second combustion reaction zone.

21 Claims, 6 Drawing Figures

FIG. 3
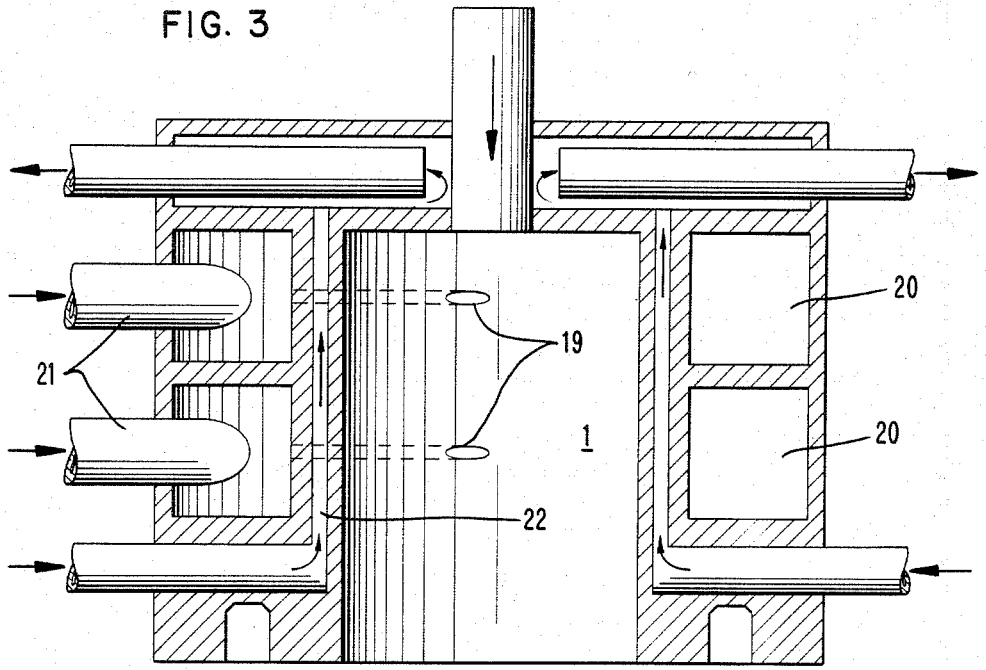
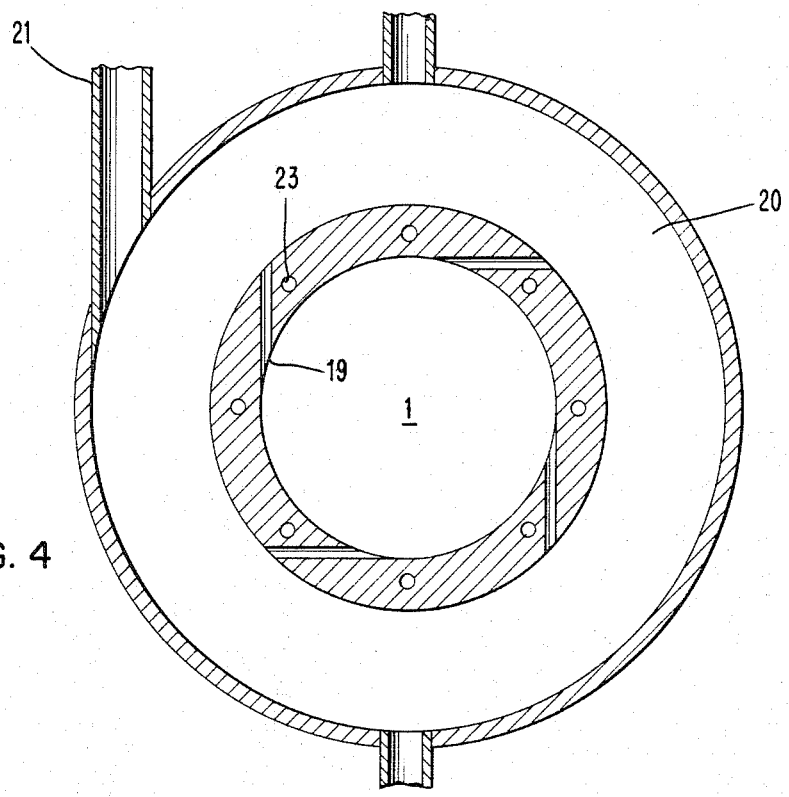
FIG. 4

CLEAN COMBUSTION PROCESS/APPARATUS

BACKGROUND OF THE INVENTION

1. Field of the Invention

The present invention relates to a clean combustion process and apparatus and, more especially, to such process/apparatus for the burning of heavy fuels.

By the term "heavy fuels", there is particularly intended:

(i) a fuel resulting from distillation of a crude oil, such as a fuel oil 4 to 6 in accordance with the ASTM standard (Burner Fuel Specification D 396; Cf. Perry and Chilton, *Chemical Engineers Handbook,* 5th edition, Section 9.9), or the crude oil itself;

(ii) or an emulsion;

(iii) or a partially or completely combustible suspension of a solid in a liquid or a gas.

By the expression "clean combustion," there is intended combustion without ultimate emission of polluting carbon-bearing particles.

2. Description of the Prior Art

It is known to this art that the emission of carbonaceous pollutants is a major disadvantage to the use of heavy fuels. Such phenomenon is manifest in the fact that solid residues are found to be formed and are included in any ash produced.

To date, however, no satisfactory solution to such problem has been found.

Now, in abandoned application, Ser. No. 916,477, filed June 19, 1978 and assigned to the assignee hereof, a process is featured for the intimate contacting of plural, physically disparate phases, wherein at least one phase is used to establish an axial helically spinning flowstream which is axially symmetrical and at least one other phase is introduced along the axis of symmetry of the axially helically spinning flowstream, into the region which is in condition of relative reduced pressure of said helical flow, with the momentum of the units of volume of the axial helical flow with respect to that of the units of volume of the axial phase introduced therein being such that the helical flow causes the rectilinear axial phase to be disintegrated, dispersed and entrained in the helical flow and optionally treated thereby.

In U.S. Pat. No. 4,124,353 assigned to the assignee hereof, process/apparatus is described for generating hot gases, by effecting combustion in a reaction zone which is in a state of relative reduced pressure within an axially symmetrical helical flowstream.

Consideration has also been given to supplying the apparatus in accordance with the aforementioned abandoned application, with a hot gas produced in accordance with the process of the aforesaid '353 patent.

However, serious technological problems were thus encountered, in particular when operating in high temperature ranges.

Next evolved the process/apparatus featured in U.S. Pat. Nos. 4,257,339 and 4,350,101, entailing effecting in situ generation of the hot gases in a first reaction zone by causing said gases to assume the configuration of an axially symmetrical helically spinning flowstream, and introducing the material to be treated into a region thereof which is in a state of relative reduced pressure, such as to avoid subjecting the sensitive or labile components of the apparatus to the prolonged action of the hot gases.

Such process/apparatus made it possible to use temperatures in excess of those temperatures deleterious to conventional steels, thus providing remarkable results as regards the size distribution of the drops produced and, consequently, the speed of vaporization of such drops.

However, it too is known that the combustion of heavy fuels poses especially unique problems due to a lack of homogeneity in the spraying thereof, which results notably in the formation of polluting black particles (soot, cenospheres, and the like). Cf. U.S. Pat. Nos. 4,263,234, 4,265,702 and 4,267,131.

SUMMARY OF THE INVENTION

Accordingly, a major object of the present invention is the provision of improved process/apparatus for the "clean" combustion of heavy fuels, which process/apparatus is conspicuously devoid of those disadvantages and drawbacks to date characterizing the state of this art.

Briefly, consistent with the present invention the following parameters are established:

(a) a gaseous combustion-supporting flowstream is initally introduced into a first region along separate helical paths which are symmetrical with respect to their common axis and a stream of combustible fluid is introduced therein, such as to provide a first dispersing combustion phase;

(b) the resulting current of flow is next forced through a zone of restricted flow passage into a second region such as to impart thereto an axially symmetrical helically spinning flow configuration; and (c) the combustible material to be treated is introduced into the region of said axial helical flowstream which is in a state of relative reduced pressure and a second combustion reaction is produced by means of a second axially symmetrical helical gaseous combustion-supporting flowstream in the second region, the amounts of combustion-supporting flowstream and combustible material introduced into the first region being sufficient to effect vaporization of the material to be treated upon entering the second region.

BRIEF DESCRIPTION OF THE DRAWINGS

FIG. 3 is an axial, diagrammatical cross-sectional view, more in detail, of one embodiment of the feed/cooling means comprising the upstream end of apparatus such as shown in FIGS. 1 and 2;

FIG. 4 is a top, diagrammatical cross-sectional view of an alternative embodiment of the feed/cooling means comprising the upstream end of apparatus such as shown in FIGS. 1 and 2;

DETAILED DESCRIPTION OF THE INVENTION

Figure 1:
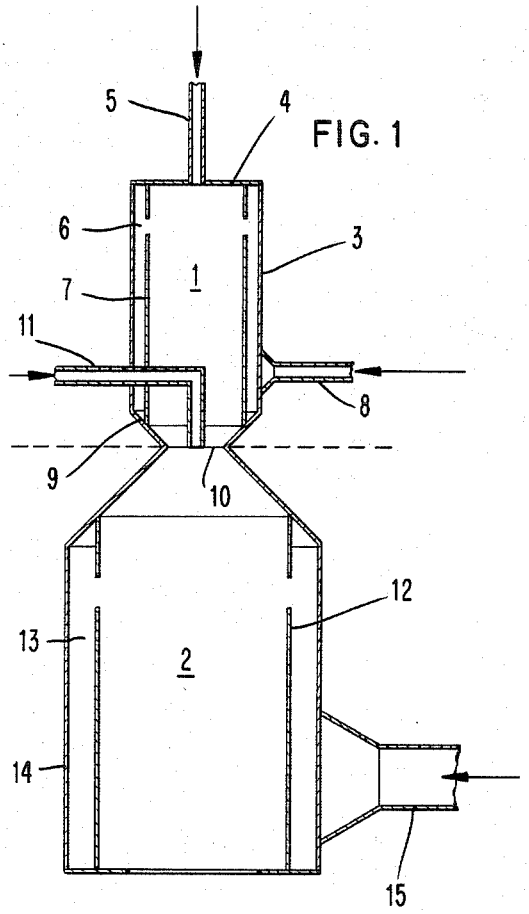
FIG. 1 is an axial, diagrammatical cross-sectional view of one embodiment of the apparatus according to the invention.

More particularly, according to the present invention, advantageously a low initial speed, preferably lower than 10 m/s and if possible lower than 5 m/s, is imparted to the combustible material which is introduced into the second region such as not to require an increase in the initial momentum of the hot dispersing gaseous phase, the ratio of momentum of said hot dispersing gaseous phase to that of the combustible material being at least equal to 100 but generally and preferably ranges from 1000 to 10,000.

The spraying or atomization effect therefore takes place by transfer of momentum and the result is virtually instantaneous dispersion in an homogeneous isodistributed condition upon entering the second region, in the form of a spectrum of fine particles which are thus under the best conditions for homogeneous and rapid vaporization. Such atomization effect will be referred to hereinafter as vaporizing atomization.

The present invention therefore avoids the problems of poor dispersion of a substance which is difficult to ignite and incomplete combustion at high temperatures.

The present invention thus provides for a unique atomization which is of a quality such as to result in the clean combustion of heavy fuels, which, as previously mentioned, was not hitherto possible.

Optionally, the second gaseous flowstream is introduced tangentially to form a helical flow, to which is imparted an axially symmetrical helically spinning flowstream configuration by means of a zone of restricted flow passage delimiting the second region. In that case, a material to be treated may be introduced axially into the region of the second flow which is in a state of relative reduced pressure. That material is, for example, a mineral solution or suspension, based on synthetic or natural carbonates, silicas, or silico-aluminates, but it may also be organic in nature, and it may also be a residual water stream which is to be purified.

The first gaseous flow for producing the axial helically spinning flow configuration advantageously comprises air.

The first fuel introduced may be supplied either in gaseous form or in the form of a spray mist which is produced by any known means, such as spraying nozzles of conventional type described in the Masters text (Spray Drying), or by an arrangement of the axial spinning flow configuration type.

The first fuel is preferably selected on the basis of its ease of combustion.

It therefore includes a range of fuels which are expensive in comparison with heavy fuels, and it will therefore be desirable to reduce the proportion thereof, relative to the heavy fuel.

The second fuel which is to be treated, such as heavy fuel oil or combustible suspension, is axially rectilinearly introduced into the region of the axial helically spinning flowstream issuing from the first region which is in a state of relative reduced pressure, such as to promote a suction effect by reason of said region which is in a state of relative reduced pressure.

The second fuel is generally a fuel corresponding to types 4 to 6 of the ASTM Standards.

The second axially symmetrical helically spinning flow configuration is produced by means of a combustion-supporting gas such as air.

The helical flows which are introduced into a given region are advantageously introduced at low pressure, preferably at a pressure of less than $10^5$ Pa with respect to the pressure prevailing immediately downstream of said region when said pressure is equal to atmospheric pressure.

The process according to the invention may be carried out utilizing apparatus akin to that described in U.S. Pat. Nos. 4,257,339 and 4,350,101, and which comprises, with reference to FIG. 1 of the accompanying drawings:

(1) A first combustion chamber 1 defining the region or reaction zone 1; and (2) A contacting and combustion chamber 2 defining the region or reaction zone 2.

The chamber 1 has a casing or wall member 3 which is terminated at its upstream end by an end plate 4, an annular space 6 delimited internally by a perforated wall member 7, an exit port 10 of restricted flow passage, at least one feed conduit 8 for the tangential feed of a gaseous flowstream and inlet means 5 for injecting the fuel within the chamber 1, the casing 3 terminating at its downstream end in a downwardly converging portion 9 with which a feed injector device 11 openly communicates, along the axis of rotational symmetry of the chamber 1, essentially at the location of the zone 10 of restricted flow passage, the contacting chamber 2 being an extension of the chamber 1 in a downstream direction along the same axis of rotational symmetry and being provided with a perforated inner wall member 12 defining, with its casing or outer wall member 14, an annular space 13 into which openly communicates at least one tangential feed inlet 15.

Figure 2:
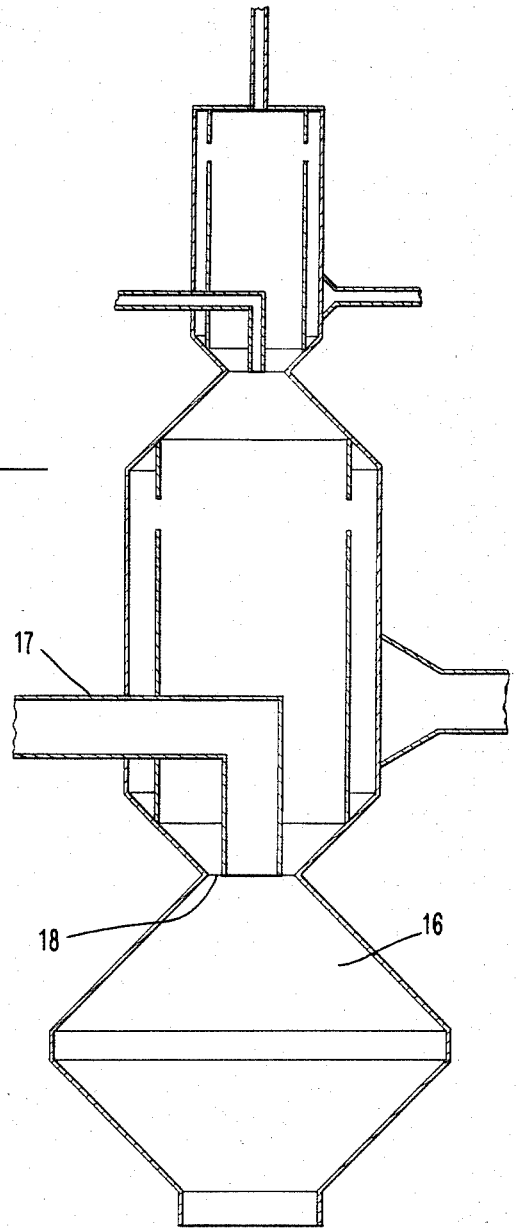
FIG. 2 is an axial, diagrammatical cross-sectional view of another embodiment of the apparatus according to the invention.

The apparatus may also comprise, as illustrated in FIG. 2, a second chamber or reaction zone 16 for treating a second material which is introduced therein by means of a second feed injector device 17 disposed essentially at the level of a second exit port 18 of restricted passage.

A hot gas is generated within the chamber 1 by combustion therein of a first fuel substance.

At the level of the zone of restricted flow passage 10 which separates the chamber 1 from the chamber 2, the material to be treated is introduced, and the localized axial helically spinning flowstream, downstream of the zone of restricted flow passage, is used to disperse the fuel into very fine units of volume (e.g., fine droplets).

In a simple case where the combustion-supporting gases comprise air and the first fuel is a gaseous hydrocarbon, normal operating conditions for the subject apparatus are as follows:

(i) the minimum temperature for vaporizing atomization of the heavy fuel ranges from 150° to 300° C., upon issuing from the isodistribution region;

(ii) the temperature of the gaseous phase issuing from the region or reaction zone 1 ranges from 400° to 1000° C.;

(iii) the ratio by weight of the amount of air introduced into the region or reaction zone 2, with respect to the amount of air introduced into region 1, ranges from 1 to 100, the latter value depending upon the final temperature envisaged in region 2; and (iv) the ratio by weight of the total amount of fuel introduced into region 1, with respect to the amount introduced into region 2, ranges from 0.01 to 0.1.

It will be appreciated that the aforementioned operating conditions may be modified in dependence upon:

(a) the nature of the gaseous combustion-supporting flowstream introduced into the region 1 (for example, oxygen instead of air); and (b) the nature of the fuel introduced into the region 1 (for example, hydrogen). When a higher temperature is to be used in the region 1, on the order of 1000° to 2500° C. in particular when using oxygen as the combustion-supporting gas, the apparatus illustrated in FIG. 3 is preferably used, having a chamber 1 with which the feed inlets 19 tangentially openly communicate, said feed inlets 19 connecting the chamber 1 to feed distribution rings 20 which are charged by means of the conduits 21.

The chamber 1 is cooled by cooling liquid circulation, comprising an annular heat exchange circuit 22 enveloping the chamber 1.

The annular space 22 may be replaced by a conduit assembly 23 which is formed within the thickness of the walls of the chamber 1, as illustrated in FIG. 4, more particularly on a smaller scale.

The temperature of the gaseous phase which issues from the second region will largely depend upon the ultimate use envisaged therefor.

Lastly, all of the aforesaid operating conditions will also depend upon the nature of the fuel to be vaporized.

In order to further illustrate the present invention and the advantages thereof, the following specific examples are given, it being understood that same are intended only as illustrative and in nowise limitative.

EXAMPLE 1

The various tests comprising this Example were carried out in the apparatus shown in FIG. 1, the operating conditions of which are reported in the following Table I.

TABLE I

| TEST | 1 | 2 | 3 | 4 | 5 | 6 | 7 | 8 |
|---|---|---|---|---|---|---|---|---|
| Air in the region 1 (A1) kg/h | 62.2 | 59.2 | 58.2 | 57.9 | 66.5 | 56.2 | 56.6 | 54.4 |
| Air in the region 2 (A2) kg/h | 1450 | 1450 | 1239 | 1450 | 1417 | 1054 | 1100 | 1047 |
| A2/A1 | 23.3 | 24.5 | 21.3 | 25 | 21.3 | 18.8 | 19.4 | 19.2 |
| T1 (*) °C. | 835 | 815 | 800 | 680 | 775 | 970 | | 950 |
| T2 (**) °C. | 1225 | 1140 | 1300 | 1140 | 1200 | 1270 | 1120 | |
| Flow rates kg/h Light fuel (o) | 19.5 | | 20.9 | 13.7 | 23.8 | | | |
| Heavy fuel (oo) | | 15 | | | | 8 | 12.5 | 19.9 |

T1 (*) = Temperature in region 1
T2 (**) = Temperature in region 2 as measured along the axis of the chamber 2, namely, within the flame
(o) = No. 2 in accordance with ASTM Standards
(oo) = No. 4 in accordance with ASTM Standards In test 8, the gas issuing from the system was subjected to a temperature re-homogenization in order to permit construction of a thermal balance sheet.
Experimental data:

| Experimental data: | Region 1 | Region 2 |
|---|---|---|
| Flow rates of inlet air, in kg/hour (measured) | 54.4 | 1047 |
| Fuel flow rates, in kg/hour | 1.5 estimated | 19.9 measured |
| Outlet temperatures, in °C. (measured) | 950 | 850 |

Calculation of the outlet temperature by evaluation in reqion 2:

Inlet: 54.4 kg/h×1,096 kJ/kg °C.×950° C.=56,848 kJ/hour

Generation: 19.9 kg/h×41,840 kJ/kg=832,616 kJ/h

Outlet: 1123 kg/h×1,075 kJ/kg °C.×t ° C.; hence, t ° C.=735° C.

The temperature measured at the center of the outlet for discharge of the gases was 850° C., which, having regard to experimental error in the measurements, was entirely in conformity with a rise in temperature of 735° C. for a gas which had previously been compressed to about $1.10^5$ Pa.

The advantages of the present invention are readily apparent from the following considerations:

(1) When combustion in the chamber 1 was effected, the internal wall member of the chamber 2 was still cold and very clean and remained so throughout the experiment; and (2) When the feed of fuel into the region 1 was cut off, it was found that:

(i) the walls of the chamber 2 were very rapidly fouled (a coating of black molten liquid oil) in proportion to a decrease in temperature of the gases of atomization, (ii) the flame changed in appearance (became brighter) and the combustion gases were charged with unburned matter, and (iii) extinction in the chamber 2 was readily achieved.

It is important to note that, for about 20 kg/h of totally burned fuel, the dimensions of the chamber 2 were as follows:

(i) Diameter: 180 mm (ii) Length: 500 mm and that, in a cold wall condition, an amount on the order of $63\times10^6$ kJ/h.m$^3$ was therefore given off, which is a very high value in relation to those which characterise conventional burners. Such dimensions are normally incompatible with combustion of heavy fuel, in particular at such flow rates, in the presence of a cold wall member, which moreover was systematically assured by cutting off the feed of fuel in the region 1.

The subject apparatus therefore permits "clean" combustion of a heavy fuel (type No. 4 in accordance with ASTM standards), with a make-up of fuel in the chamber 1, on the order of 1 to 10% by weight (with respect to the heavy fuel).

EXAMPLE 2

The procedure of this Example is also carried out in the apparatus shown in FIG. 1 and under the calculated operating conditions noted below and also reported in the following Table II:

| | |
|---|---|
| For 1000 kg/h of nonadecane: | Heat of vaporization = 365 kJ/kg at 25° C. Heat of combustion = 44,279 kJ/kg |

TABLE II

| Amount of air introduced into region 1 | 1000 kg/h | 1500 kg/h | 2000 kg/h | 2500 kg/h |
|---|---|---|---|---|
| Minimum temperature on issuing | 239° C. | 227° C. | 219° C. | 213° C. |

TABLE II-continued

| | | | | | | | |
|---|---|---|---|---|---|---|---|
| from the region of isodistribution | | | | | | | |
| Minimum temperature on issuing from region 1 | 878° C. | | 651° C. | 535° C. | | | 464° C. |
| Amount of $C_3H_8$ introduced into region 1 | 22 kg/h | | 23.4 kg/h | 25.7 kg/h | | | 27.1 kg/h |
| Temperature sought on issuing from region 2 | 500° C. | 700° C. | 900° C. | 500° C. | 700° C. | 900° C. | |
| Amount of air introduced into region 2 | 83 T/h | 57 T/h | 42 T/h | 82 T/h | 56 T/h | 42 T/h | |

The process/apparatus according to the invention makes it possible to generate hot gases which contain very few or no solid particles from very low-grade fuels, and the economic implications thereof are readily apparent in uses such as: drying, heating, production of steam and electricity and in general any use of "heavy" fuels, distillation residues, combustible suspensions, etc.

In fact, a "gas flame" is established which is much less bright (that is to say, containing fewer solid radiating particles) when vaporizing atomization of the fuel is effected by hot gas, than when simple atomization in combustion air is used.

Moreover, the apparatus for introducing the principal fuel effects but slight pressure drop in the flow thereof. It therefore provides for the injection of a mixture comprising a plurality of phases (slurries or dense pneumatically conveyed materials) or a plurality of such mixtures which are subjected to cospraying (for example, by being introduced coaxially), which enjoys the following advantages over present-day processes:

(1) Very little drive pressure required ($<3\times10^5$Pa, for example, if combustion takes place at about atmospheric pressure); therefore, only simple pumping apparatus is required, such means not being subjected to the forces of abrasion.

(2) No spraying nozzle system is required, which would also be subjected to severe forces of abrasion.

(3) The option of co-injection of material for treating, in situ, and within the flame itself, any undesirable by-products which are produced by combustion (for example, $SO_2$).

Any such co-injected materials (such as very fine carbonates) may be injected:

(i) separately: solution, slurry, pneumatic conveying material; or (ii) in the form of a mixture: stabilized suspension.

(4) The option of treating coal-base mixtures by means of hot gases, such gases containing oxygen, either for total combustion of the carbon or for partial combustion thereof in the presence of agents for oxidizing such carbon, with the goal of "gasification" thereof (steam and/or carbon dioxide, for example).

Figure 5:
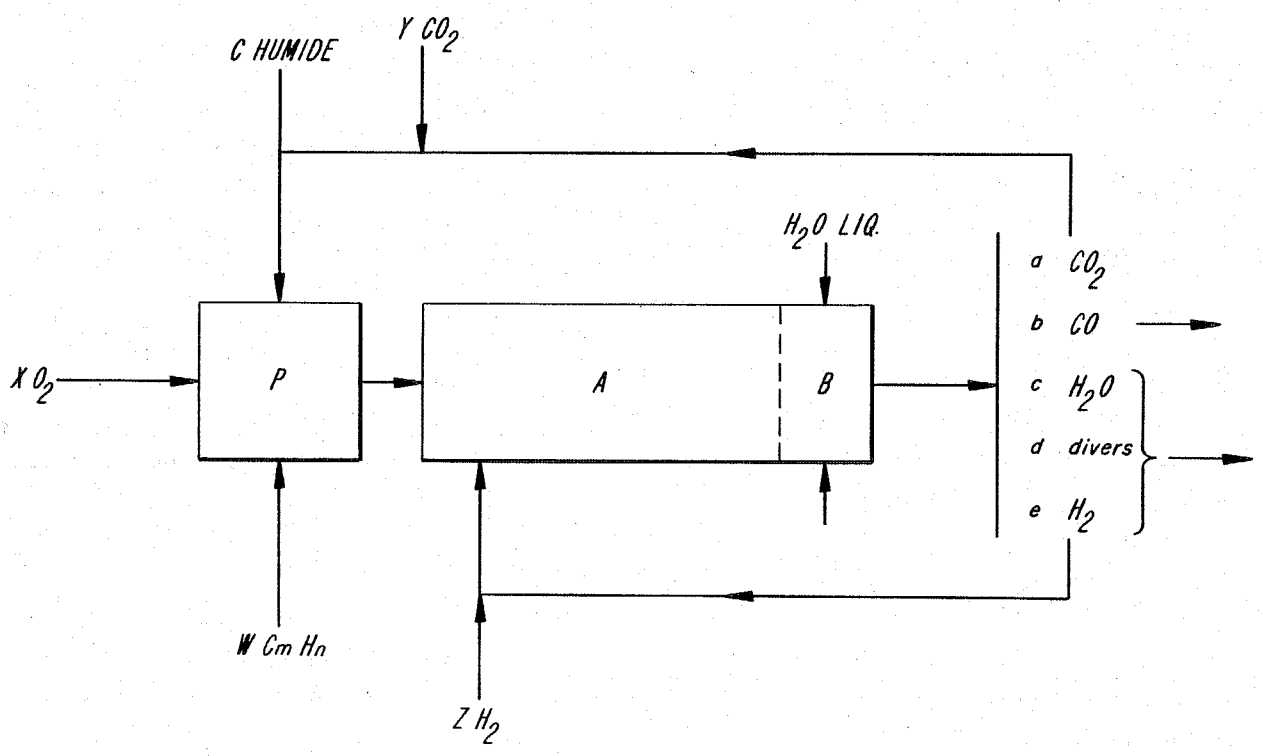
FIG. 5 is a schematic/diagrammatic view of one embodiment of process/apparatus according to the invention.
Figure 6:
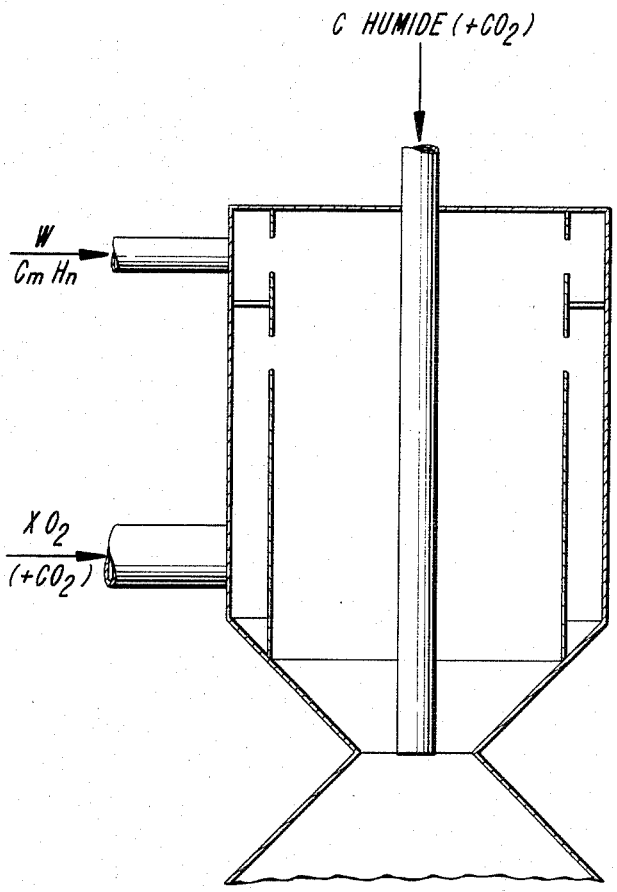
FIG. 6 is an axial, diagrammatical cross-sectional view of the reaction zone P shown in FIG. 5.

One embodiment of such gasification treatment is illustrated in FIG. 5 in which P is an apparatus according to the invention adapted to this type of feed (more particularly shown in FIG. 6).

A preliminary region P provides for combustion with oxygen of a hydrocarbon $C_mH_n$, optionally in the presence of $CO_2$.

At the situs of the zone of restricted flow passage characterizing the apparatus according to the invention, a solid carbon-bearing material such as crushed coal, either in wet form or pneumatically conveyed by $CO_2$, or any other means, is introduced into the apparatus.

FIG. 5 illustrates the respective rates of feed flow for the regions P and A: for 1 of carbon, W $C_m H_n$, $XO_2$, Y $CO_2$ and $ZH_2$ are introduced, $C_m H_n$ denoting either hydrogen or a hydrocarbon.

Gasification of the solid carbon-bearing material is effected in region A by the $CO_2$ introduced and the combustion gases issuing from the preliminary region P. Other reactants, such as, for example, hydrogen, may optionally also be introduced into the region A.

Finally, rapid quenching is carried out in the region B by a third material, such as water.

Such process/apparatus makes it possible to produce a synthesis gas whose composition depends upon the operating conditions of P and A.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for the clean combustion of a combustible material, comprising (i) in situ generating a dispersing first stream of hot combustion gases by establishing a first downstream axially extending, axially symmetrical helical flowstream of combustion-supporting gases in a first combustion reaction zone and by introduction and combustion of a combustible fluid feedstream therein, (ii) serially directly contacting and intimately admixing the material cleanly combustible hereby with said first stream of hot combustion gases at a zone of reduced pressure thereof defining the inlet end of a second combustion reaction zone and whereat and downstream thereof said first stream of hot combustion gases is also in the configuration of an axially symmetrical helical flowstream, (iii) the amounts of said combustion-supporting gases and said combustible fluid being such as to effect essentially instantaneous dispersion and entrainment of fine particles of said cleanly combustible material at and downstream of said point of direct contact with said first stream of hot combustion gases, (iv) establishing a second downstream axially extending, axially symmetrical helical flowstream of combustion-supporting gases in said second combustion reaction zone, and (v) whereby said cleanly combustible material dispersed and entrained within said first stream of hot combustion gases is introduced into and combusted within said second stream of combustion-supporting gases in said second combustion reaction zone.

2. The process as defined by claim 1, said zone of reduced pressure comprising an outlet of restricted flow passage.

3. The process as defined by claim 1, the momentum of said first stream of hot combustion gases being at least 100 times greater than the momentum of said cleanly combustible material at said zone of reduced pressure.

4. The process as defined by claim 3, the momentum of said first stream of hot combustion gases ranging from 1000 to 10,000 times greater than the momentum of said cleanly combustible material.

5. The process as defined by claim 3, said cleanly combustible material being introduced at a rate of less than 10 m/s.

6. The process as defined by claim 1, said first flowstream of combustion-supporting gases comprising air.

7. The process as defined by claim 6, said second flowstream of combustion-supporting gases also comprising air.

8. The process as defined by claim 1, the temperature in said first combustion reaction zone ranging from 1000° to 2500° C.

9. The process as defined by claim 1, said cleanly combustible material comprising a heavy fuel.

10. The process as defined by claim 9, said cleanly combustible material comprising No. 4 to No. 6 fuel oil.

11. The process as defined by claim 1, said combustible fluid comprising a gaseous hydrocarbon.

12. The process as defined by claim 1, said combustible fluid comprising a liquid hydrocarbon.

13. The process as defined by claim 1, said cleanly combustible material comprising a combustible suspension.

14. The process as defined by claim 1, wherein the pressure downstream thereof is about atmospheric, there is a pressure differential between same and a symmetrical helical flowstream of less than about $10^5$ Pa.

15. The process as defined by claim 1, said combustible fluid comprising hydrogen.

16. The process as defined by claim 1, said cleanly combustible material comprising a solid, carbon-containing material.

17. The process as defined by claim 1, said first and second flowstreams of combustion-supporting gases comprising air, with the ratio by weight of the amount of air comprising said second flowstream of combustion-supporting gases to the amount of air comprising said first flowstream of combustion-supporting gases ranging from 1 to 100, the ratio by weight of the total amount of combustible fluid introduced to the total amount of cleanly combustible material introduced ranging from 0.01 to 0.1, and the temperature of said first stream of hot combustion gases exiting said first combustion reaction zone ranging from 400° to 1000° C.

18. The process as defined by claim 1, further comprising serially directly contacting and intimately admixing a third material with the second stream of hot combustion gases at a zone of reduced pressure thereof defining the inlet end of a treatment third zone and whereat and downstream thereof said second stream of hot combustion gases is also in the configuration of an axially symmetrical helical flowstream.

19. Apparatus adopted for the clean combustion of a combustible material, comprising (i) a first hollow casing member closed at the upstream end thereof, (ii) a first perforated sleeve inwardly spaced from said casing and defining (iii) a first annular interspace therebetween, (iv) a downstream converging wall section of said casing terminating in (v) a first outlet port of reduced cross-section, and defining a zone of restricted flow passage, (vi) a first reaction chamber within said first perforated sleeve, (vii) at least one tangential feed inlet communicating with said first annular interspace for establishing an axially symmetrical helical downstream flow of reactants within said first reaction chamber, (viii) at least one non-tangential feed inlet communicating with said first reaction chamber, (ix) a second hollow casing member integrally communicating with said first hollow casing member at said port of reduced cross-section and first outwardly flaring and then directly extending downstream thereof, (x) a second perforated sleeve inwardly spaced from said second casing and defining a second annular interspace therebetween, (xi) a second reaction chamber within said second perforated sleeve, (xii) at least one tangential feed inlet communicating with said second annular interspace for establishing an axially symmetrical helical downstream flow of reactants within said second reaction chamber, (xiii) an inlet for injecting feed into said second reaction chamber, at the upstream end thereof essentially comprising said first outlet port of reduced cross-section, and (xiv) a second reaction chamber outlet port.

20. The apparatus as defined by claim 19, said inlet into said second reaction chamber being adopted to inject feed along the longitudinal axis thereof.

21. The apparatus as defined by claim 19, said second casing member comprising a downstream converging wall section terminating in an outlet port of reduced cross-section, and defining a second zone of restricted flow passage, and a third hollow casing member integrally communicating with said second hollow casing member at said second port of reduced cross-section and defining a treatment zone downstream therefrom.

* * * * *